US005779372A

United States Patent [19]

Jorgensen

[11] Patent Number: 5,779,372

[45] Date of Patent: Jul. 14, 1998

[54] HOT STAMP IMPRINTING SYSTEM WITH LOCKING CAM REEL HUBS

[75] Inventor: Arne R. Jorgensen, Woodridge, Ill.

[73] Assignee: Illinois Tool Works, Inc., Glenview, Ill.

[21] Appl. No.: 725,930

[22] Filed: Oct. 7, 1996

[51] Int. Cl.[6] ..... B41J 31/00

[52] U.S. Cl. ..... 400/191; 400/236

[58] Field of Search ..... 400/191, 192, 400/235, 236, 418.1, 227.2, 236.2, 234

[56] References Cited

U.S. PATENT DOCUMENTS

| | | | |
|---|---|---|---|
| 4,812,063 | 3/1989 | Kunimitsu et al. | 400/234 |
| 4,919,555 | 4/1990 | Kikuchi | 400/234 |
| 5,399,036 | 3/1995 | Yamaguchi | 400/236 |

*Primary Examiner*—Edgar S. Burr
*Assistant Examiner*—Anthony H. Nguyen
*Attorney, Agent, or Firm*—John P. O'Brien

[57] ABSTRACT

A printing system for transferring ink from an inked ribbon supplied from a ribbon roll having a tubular core with an inner surface onto a substrate. The system includes a rotatable locking cam hub having a reel hub with a first surface engageable with the inner surface of the ribbon roll, and an eccentric hub having a second surface engageable with the inner surface of the ribbon roll. The eccentric hub is rotatable relative to the reel hub to provide a variable diameter between the first surface of the reel hub and the second surface of the eccentric hub. The diameter of the locking cam hub may be reduced by rotating the eccentric hub relative to the reel hub to permit disposal of the ribbon roll tubular core about locking cam hub, and the diameter of the locking cam hub may be increased by rotating the eccentric hub relative to the reel hub to engageably retain the inner surface of the ribbon roll by the first surface of the reel hub and the second surface of the eccentric hub. The locking cam hub includes a knurled outer surface to prevent rotational and axial slippage of the ribbon roll relative to the hub, and a spring member to prevent vibrationally induced rotation between the reel hub and the eccentric hub.

10 Claims, 2 Drawing Sheets

HOT STAMP IMPRINTING SYSTEM WITH LOCKING CAM REEL HUBS

CROSS-REFERENCE TO RELATED APPLICATIONS

The present application is related to the following several co-pending applications U.S. application Ser. No. 08/725,932, filed 7 Oct. 1996 and entitled "Hot Stamp Imprinting System With Backup Pad Assembly", U.S. application Ser. No. 08/725,928, filed 7 Oct. 1996 and entitled "Hot Stamp Imprinting System With Latchable Ink Ribbon Cassette and U.S. application Ser. No. 08/725,929, filed 7 Oct. 1996 and entitled Handle", and "Hot Stamp Imprinting System With Variable Typeholder", all assigned to the common assignee of the present invention and incorporated herein by reference.

BACKGROUND OF THE INVENTION

The invention generally relates to printing systems for transferring ink from an inked ribbon supplied from a ribbon roll onto a substrate, and more particularly to hot stamp imprinters with one or more hubs for engageably retaining a corresponding ribbon roll that supplies inked ribbon for imprinting onto a substrate.

Hot stamp imprinter systems are used often by the packaging industry in labeling and packaging production lines to produce high quality imprints of lot numbers, expiration dates, production codes, and other variable information on a variety of substrates including labels and packages. Hot stamp imprinter systems include generally an inked ribbon disposed between a back-up pad and a heated print head assembly. And the print head assembly includes a typeholder having a typeface with alpha-numeric characters and logos, and the print head assembly is movable toward and away from the backup pad by a cam or pneumatic actuator mechanism to transfer ink from the inked ribbon onto a portion of substrate disposed between the inked ribbon and the backup pad. Between imprints, the inked ribbon is advanced from a ribbon supply roll to a ribbon take-up roll to position an unused portion of inked ribbon between the print head assembly and the backup pad for the next imprint. The substrate is also advanced between imprints by a substrate feed mechanism to position an adjacent portion of the substrate between the print head and the backup pad for the next imprint.

The inked ribbon is comprised generally of a dye disposed on one side of a Mylar carrier, which is coiled about a tubular core member to form a ribbon supply roll. And the ribbon supply roll is disposed about a rotatable supply reel hub, and an end portion of the ribbon is coiled about a used ribbon roll formed by another tubular core member disposed about a take-up reel hub. According to one configuration of the present invention, the take-up reel is driven by a rewind belt from a feed roll. The feed roll, in turn, is driven through a coupling from a timing belt which converts linear travel of a pneumatic actuator to rotary movement required to drive the feed roll and the take-up reel. A series of idler guide rolls usually guide the ribbon between the print head and the backup pad as the ribbon is transferred from the ribbon supply roll to the used ribbon roll. And the supply reel incorporates a brake drum and brake arm assembly, which controls tension in the ribbon through the activation of a dancer arm within the ribbon path.

The tubular core members that form the ribbon supply roll and the used ribbon roll are formed of cardboard and other materials. These tubular core members, however, do not always fit snugly over the hubs due to variation in the inner core diameter. These variations of inner core diameter result very often in slippage of the tubular core members relative to the respective hubs. More specifically, slippage of the used ribbon core member disposed about the take-up reel hub may result in improper or inadequate advancing of the ribbon between imprints, which adversely affects imprint quality. And slippage of the ribbon supply roll core member about the supply reel hub may result in excess or premature unwinding of the ribbon from the supply roll, which may cause improper ribbon tensioning or entanglement of the ribbon. A loose fitting tubular core member also has a tendency to deviate axially relative to the hub, which may result in a misfeeding of the ribbon or damage thereto. A loose fitting tubular core member also complicates installation of the ribbon supply roll and used ribbon roll, particularly in applications where the imprinter is oriented so that a loose fitting ribbon roll has a tendency to fall or otherwise separate from the hub under the influence of gravity and vibration during installation. This problem is especially significant in systems where the supply reel hub and take-up reel hubs are mounted on a removable ink ribbon cassette that is mateably engageable with the imprinter upon replacement of the ribbon supply roll and used ribbon roll. In a related problem, inked ribbon coiled loosely, whether or not the ribbon is coiled about a tubular core member, has a tendency to separate telescopically under the influence of gravity in some spatial orientations.

In view of the discussion above among other considerations, there exists a demonstrated need for an advancement in the art of imprinting systems with a ribbon reel hub.

It is therefore an object of the invention to provide a novel imprinting system with a ribbon reel hub that overcomes problems in the prior art and is economical.

It is also an object of the invention to provide a novel imprinting system with a rotatable ribbon reel hub that compensates for variation in the diameter of ribbon roll tubular cores.

It is another object of the invention to provide a novel imprinting system with a rotatable ribbon reel hub having a variable diameter locking cam hub for engageably retaining a ribbon roll without rotational or lateral slippage of the ribbon roll relative to the hub.

It is another object of the invention to provide a novel imprinting system with a rotatable ribbon reel hub having an eccentric hub rotatable relative to a reel hub for increasing and decreasing a diameter of the hub, wherein the locking cam hub has one or more of a knurled outer surface and an axial outer edge portion for engaging and retaining an inner surface of a ribbon roll tubular core when the diameter of the locking cam hub is increased.

It is a further object of the invention to provide a novel imprinting system having a locking cam hub formed by an eccentric hub rotatable relative to a reel hub for varying a diameter of the hub, wherein the locking cam hub includes a spring member interconnected between the reel hub and the eccentric hub for preventing vibrationally induced rotation therebetween.

It is a further object of the invention to provide a novel imprinting system having a locking cam hub formed by an eccentric hub rotatable relative to a reel hub for varying a diameter of the hub, wherein a first support plate is engageable with a first side portion of a ribbon roll disposed over the locking cam hub and a second support plate biased toward and engageable with an opposing second side of the ribbon roll to prevent telescoping uncoiling of the ribbon roll.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
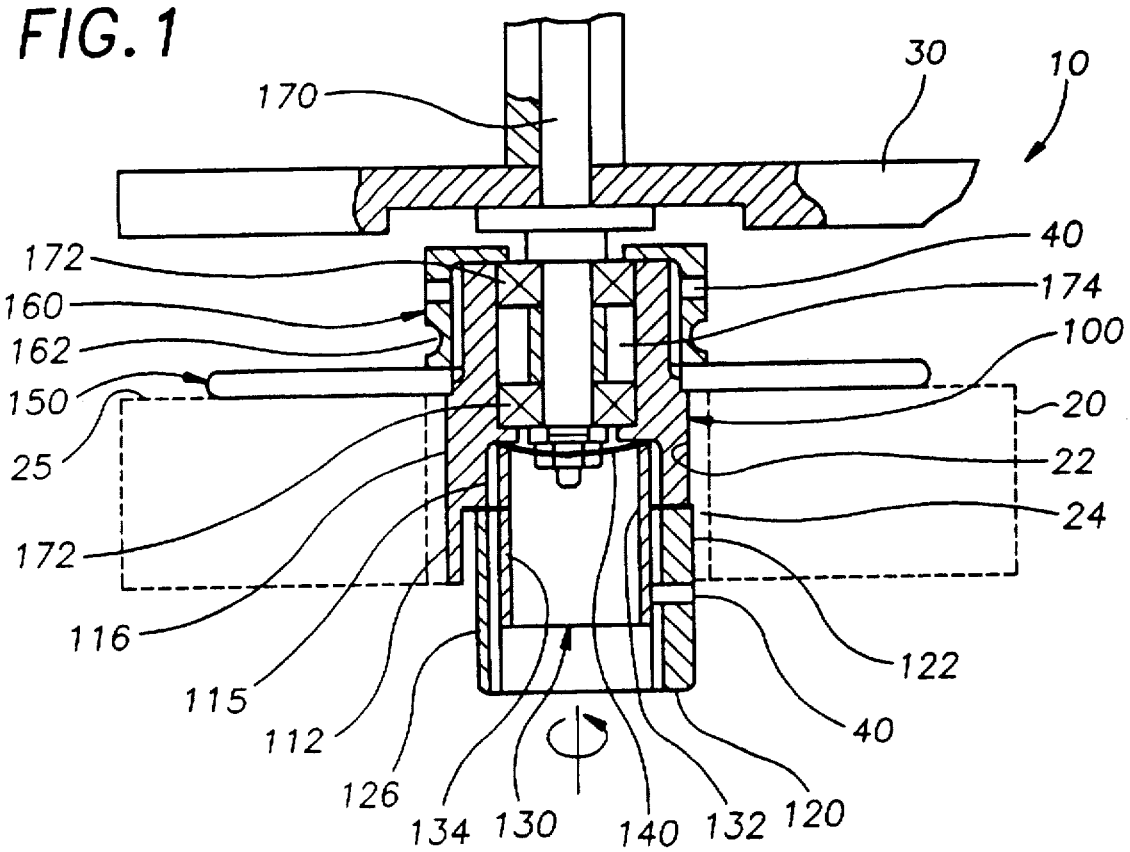
FIG. 1 is a partial sectional view of an imprinting system with a locking cam reel hub with a variable outer diameter according to an exemplary embodiment of the invention.

The exemplary embodiments of the invention are disclosed in the context of imprinting systems and more particularly hot stamp imprinters for transferring ink from an inked ribbon onto a substrate, not shown in the drawing, wherein the inked ribbon is supplied from a ribbon roll. FIG. 1 is an imprinting system 10 including generally one or more cam-locking hubs 100 for engageably retaining a corresponding ribbon roll 20, which has a tubular core with an inner surface 22 mountable about the hub. The inked ribbon rolls discussed herein include generally an inked ribbon coiled about a separate cardboard or plastic tubular core member 24, which defines the inner surface disposed about the hub. The invention, however, is applicable to ribbon rolls having a tubular core with an inner surface, which is defined by the ribbon roll in the absence of a separate tubular core member, and still more generally to any member having a tubular core with an inner surface, which is mountable about a hub.

Figure 2A:
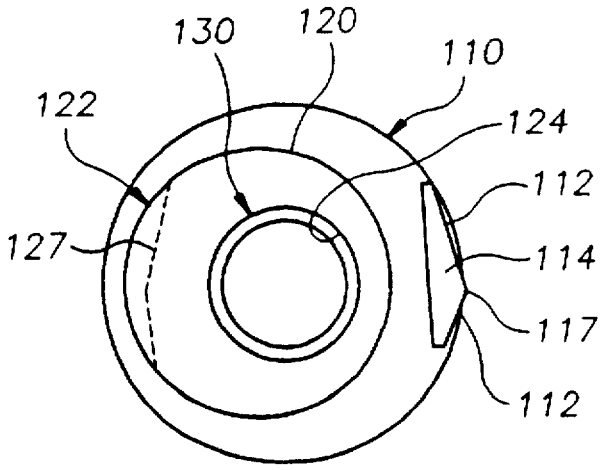
FIG. 2*a* is a partial diagrammatic end view of an imprinting system with a locking cam reel hub with a relatively enlarged outer diameter.
Figure 2B:
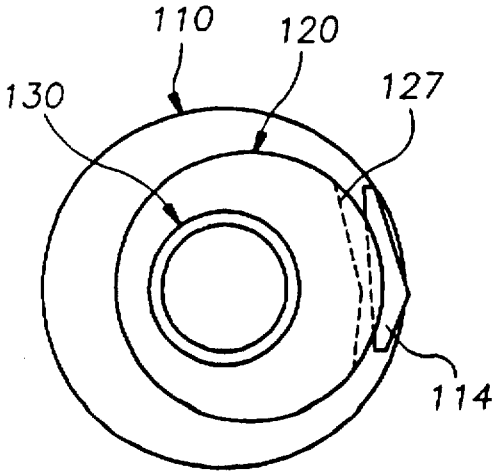
FIG. 2*b* is a partial diagrammatic end view of an imprinting system with a locking cam reel hub with a relatively decreased outer diameter.

The locking cam hub 100 of FIG. 1 includes generally a reel hub 110 with a first surface 112 on a protruding member 114 engageable with the inner surface 22 of the ribbon roll 20, and an eccentric hub 120 with a second surface 122 engageable with the inner surface 22 of the ribbon roll 20. FIGS. 2*a* and 2*b* show the eccentric hub 120 rotatable relative to the reel hub 110 to provide a variable diameter between the first surface 112 of the reel hub 110 and the second surface 122 of the eccentric hub 120. The diameter between the first surface 112 of the reel hub 110 and the second surface 122 of the eccentric hub 120 is reduceable by rotating the eccentric hub 120 relative to the reel hub 110 to permit disposal of the ribbon roll tubular core 22 about the first surface 112 of the reel hub 110 and the second surface 122 of the eccentric hub 120. The diameter between the first surface 112 of the reel hub 110 and the second surface 122 of the eccentric hub 120 is increaseable by rotating the eccentric hub 120 relative to the reel hub 110 to engageably retain the inner surface 22 of the ribbon roll 20 by the first surface 112 of the reel hub 110 and the second surface 122 of the eccentric hub 120.

According to the exemplary embodiments of FIGS. 1 and 2, a collar 130 interconnects the reel hub 110 and the eccentric hub 120. A first end portion 132 of the collar 130 is rotatably and engageably disposed in a bore 115 of the reel hub 110, for example by screw threads on an inner surface of the bore 115 and on the outer surface of the collar 130. A second end portion 134 of the collar 130 is fixedly disposed in a bore 124 of the eccentric hub 120. The collar 130 and the eccentric hub 120 may be similarly coupled by screw threads on the outer surface of the collar 130 and on the inner surface of the bore 124 and fixedly engaged by one or more set screws 40. The eccentric hub 120 is a substantially cylindrical member and the bore 124 is located non-concentrically, which provides a camming action upon rotation of the eccentric hub 120. In alternative embodiments, the eccentric hub 120 may be formed of a body member with an irregular outer circumferential shape.

According to the exemplary configuration of FIGS. 1 and 2, the diameter between the first surface 112 of the reel hub 110 and the second surface 122 of the eccentric hub 120 is variable by rotating the fixedly coupled collar 130 and eccentric hub 120 in unison relative to the reel hub 110. A threaded collar 130 also permits adjusting telescopingly the axial dimension of the cam locking hub 100 for accommodating different width ribbon rolls 20. The eccentric hub 120 may include a recessed portion 127 on an end portion thereof proximate the reel hub 110 to provide clearance between the eccentric hub 120 and the protruding portion 114 of the reel hub 110 during relative rotation therebetween.

According to another aspect of the invention, a spring member 140 interconnects the collar 130 and the reel hub 110 to prevent vibrationally induced rotation of the eccentric hub 120 relative to the reel hub 110. In the exemplary embodiment of FIG. 1, the spring member 140 is a stainless steel curved spring washer disposed between an end portion of the collar 130 and the reel hub 110. These curved spring washers are available commercially from Associated Spring Raymond, Part No. U437-0150-S. According to a related aspect of the invention, one or both of the reel hub 110 and the eccentric hub 120 may have knurled outer surface portions 116 and 126, respectively, to facilitate retention of the ribbon roll and to facilitate manual gripping during rotational adjustment of the diameter between the first surface 112 of the reel hub 110 and the second surface 122 of the eccentric hub 120. The knurled surface tends to prevent axial and rotational slippage of the ribbon roll relative to the locking cam hub 100, and also reduces the tendency of vibrationally induced rotation of the reel hub 110 relative to the eccentric hub 120. And according to another aspect of the invention, the first surface 112 on the protruding member 114 of the reel hub 110 includes an axial edge portion 117 for engaging the inner surface 22 of the ribbon roll 20. An angle defining the edge 117 may be increased or decreased to vary the extent to which the edge 117 engages or bites into the inner surface 22 of the ribbon roll 20. The edge portion 117 tends to bite into the inner surface 22 of the ribbon roll when the diameter between the first surface 112 and the second surface 122 are increased to provide relatively improved engageable retention of the ribbon roll 20 about the locking cam hub 100.

According to another aspect of the invention, a first support plate 150 is fixed axially along the rotation axis of the reel hub 110 and extends substantially radially from the reel axis rotation axis. The first support plate 150 is engageable with a first side portion 25 of a ribbon roll 20 engageably retained by the first surface 112 of the reel hub 110 and the second surface 122 of the eccentric hub 120. In the exemplary embodiment of FIG. 1, the first support plate 150 is coupled to the reel hub 110 by a drive pulley 160 threadedly engaged and fixedly retained to the reel hub 110 by one or more set screws 40. The drive pulley 160 may include a recess 162 for receiving a drive belt for rotatingly driving the locking cam hub 100. According to a related aspect of the invention, the reel hub 110 is rotatably coupled to an idler support shaft 170 fixedly coupled to a portion 30 of the printing system 10. One or more bearings 172, which bearings are separated by a bearing spacer 174 in FIG. 1, may rotatably couple the locking cam hub 100 to the idler support shaft 170.

According to yet another aspect of the invention, the portion 30 of the printing system 10 is a ribbon roll cassette removably coupled to the printing system 10, wherein one or more locking cam hubs 100 are rotatably coupled to the ribbon roll cassette 30. In one configuration, a first locking cam hub, not shown in the drawing, retains a ribbon supply roll and a second locking cam hub retains a used ribbon roll, as shown in the drawing, wherein the first locking cam hub is an idler hub restrained from rotation by a combination brake drum and brake arm, which is activated by the movement of the ribbon past a dancer arm to maintain ribbon tension during transfer of ribbon from the supply roll to the used ribbon roll. According to this configuration, the second locking cam hub, which is an idler hub free to rotate in at least one direction, is rotatably driven by a rewind belt from the feed roll, which is coupled to a timing belt that converts linear travel of a pneumatic actuator to rotary movement of the feed roll and the ribbon take-up reel.

Figure 3:
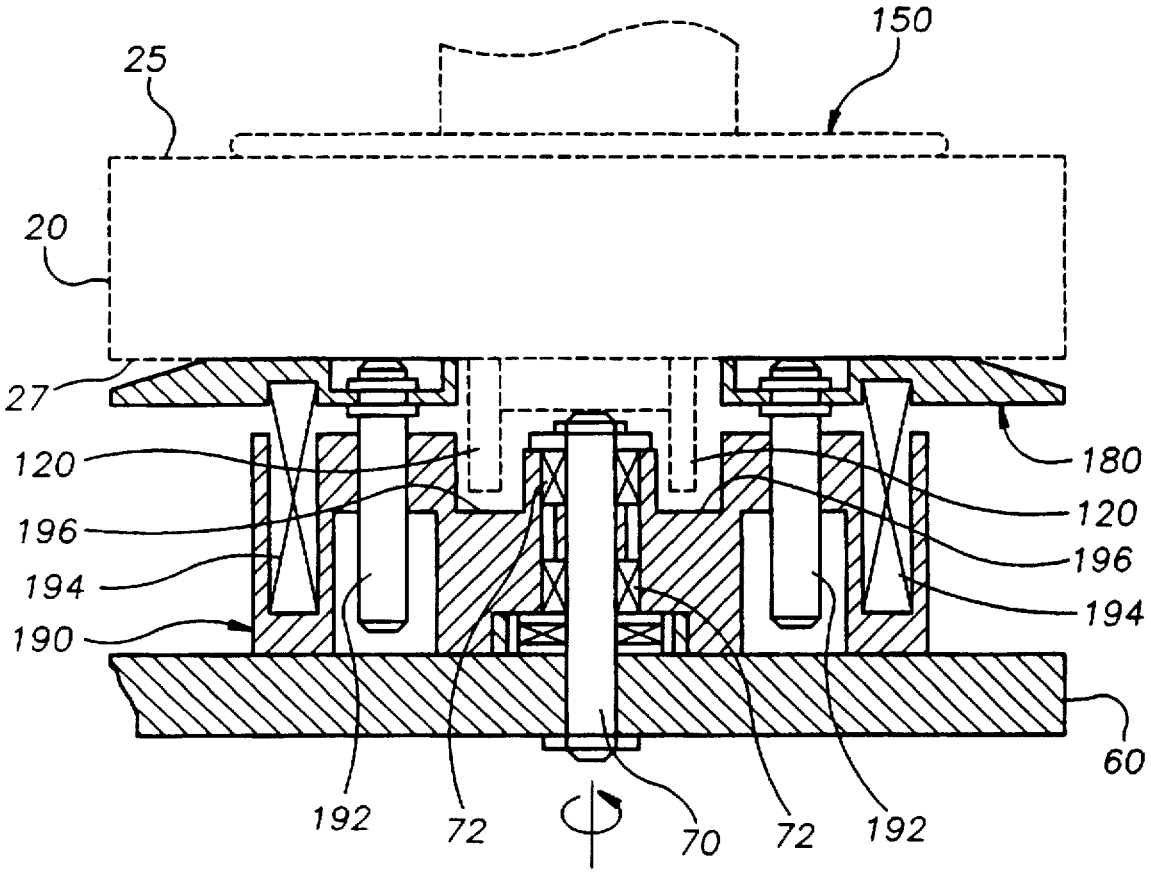
FIG. 3 is a partial sectional view of an imprinting system with a ribbon reel retaining plate engageable with a second side surface of a ribbon roll engageably retained on a reel hub according to an exemplary embodiment of the invention.

According to still a further aspect of the invention shown in FIG. 3, a second support plate 180 is biased toward the first support plate 150 and is engageable with a second opposing side portion 27 of a ribbon roll 20, shown in phantom, engageably retained by the first surface 112 of the reel hub 110 and the second surface 122 of the eccentric hub 120. The second support plate 180 prevents the tendency of loosely coiled ribbon rolls 20 from uncoiling telescopingly away from the first support plate 150, which may occur during installation, handling of a removable ribbon cassette or as a result of printing system spatial orientation. The second support plate 180 is aligned and rotatable about substantially the same rotation axis as the locking cam hub 100. In the exemplary embodiment, of FIG. 3, a plate hub 190 rotatably interconnects the second support plate 180 and a portion 60 of the printing system 10. The second support plate 180 is telescopingly coupled to the plate hub 190 by one or more shaft members 192 and is biased away therefrom and toward the ribbon roll 20 by spring members 194. The plate hub 190 is rotatably coupled to a support shaft 70 by bearings 72, and the plate hub 190 includes a concentric recessed portion 196 for receiving an end portion of the eccentric hub 120, which is also shown in phantom in FIG. 3.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. An imprinting system for transferring ink from an inked ribbon onto a substrate, the inked ribbon supplied from a ribbon roll having a tubular core with an inner surface, the system comprising:

a reel hub rotatable about an axis, the reel hub having a first surface engageable with the inner surface of the ribbon roll; and an eccentric hub having a second surface engageable with the inner surface of the tubular core, the eccentric hub rotatable relative to the reel hub to provide a variable diameter between the first surface of the reel hub and the second surface of the eccentric hub, wherein the diameter between the first surface of the reel hub and the second surface of the eccentric hub is reduceable by rotating the eccentric hub relative to the reel hub to permit disposal of the ribbon roll tubular core about the first surface of the reel hub and the second surface of the eccentric hub, and wherein the diameter between the first surface of the reel hub and the second surface of the eccentric hub is increaseable by rotating the eccentric hub relative to the reel hub to engageably retain the inner surface of the tubular core by the first surface of the reel hub and the second surface of the eccentric hub.

2. The imprinting system of claim 1, further comprising a collar interconnecting the reel hub and the eccentric hub, the collar having a first end portion rotatably and engageably disposed in a bore of the reel hub, and the collar having a second end portion fixedly disposed in a bore of the eccentric hub, wherein the diameter between the first surface of the reel hub and the second surface of the eccentric hub is variable by rotating the collar relative to the reel hub.

3. The imprinting system of claim 1, further comprising a spring member interconnecting the reel hub and the eccentric hub, wherein the spring member prevents vibrationally induced rotation of the reel hub relative to the eccentric hub, wherein one of the reel hub and the eccentric hub include a knurled outer surface.

4. The imprinting system of claim 1, wherein the first surface of the reel hub includes an axial edge portion engageable with the inner surface of the tubular core when the diameter between the first surface of the reel hub and the second surface of the eccentric hub is increased to engageably retain the ribbon roll.

5. The imprinting system of claim 1, further comprising a first support plate fixed along the rotation axis of the reel hub, the first support plate extending substantially radially from the reel hub rotation axis, wherein the first support plate is engageable with a first side portion of a ribbon roll engageably retained by the first surface of the reel hub and the second surface of the eccentric hub.

6. The imprinting system of claim 5, further comprising a ribbon roll cassette removably coupleable to the printing system, the reel hub rotatably coupled to the ribbon roll cassette.

7. The imprinting system of claim 5, further comprising a second support plate coupled to the printing system, the second support plate aligned and rotatable about substantially the same rotation axis as the reel hub, the second support plate biased toward the first support plate and engageable with a second opposing side portion of a ribbon roll engageably retained by the first surface of the reel hub and the second surface of the eccentric hub.

8. The imprinting system of claim 7, further comprising a plate hub interconnecting the second support plate and the printing system, the plate hub rotatably coupled to the printing system, and the second support plate telescopingly coupled to the plate hub and biased away from the plate hub by a spring member.

9. A method for transferring ink from an inked ribbon onto a substrate in an imprinting system, the inked ribbon supplied from a ribbon roll having a tubular core with an inner surface, the method comprising steps of:

providing a reel hub having a first surface and an eccentric hub having a second surface, decreasing a diameter between the first surface of the reel hub and the second surface of the eccentric hub by rotating the eccentric hub relative to the reel hub to permit disposal of the ribbon roll tubular core about the first surface of the reel hub and the second surface of the eccentric hub;

increasing the diameter between the first surface of the reel hub and the second surface of the eccentric hub by rotating the eccentric hub relative to the reel hub to engageably retain the inner surface of the tubular core by the first surface of the reel hub and the second surface of the eccentric hub; and rotating the reel hub and the eccentric hub about a rotation axis of the reel hub to supply inked ribbon from the ribbon roll.

10. The method of claim 9 further comprising steps of:

engaging an axial edge portion of the first surface of the reel hub with the inner surface of the tubular core when the diameter between the first surface of the reel hub and the second surface of the eccentric hub is increased to engageably retain the ribbon roll;

supporting a first side portion of a ribbon roll engageably retained by the first surface of the reel hub and the second surface of the eccentric hub with a first support plate fixed along the rotation axis of the reel hub, the first support plate extending substantially radially from the reel hub rotation axis; and biasing a second support plate toward the first support plate for supporting a second opposing side portion of the ribbon roll engageably retained by the first surface of the reel hub and the second surface of the eccentric hub.

* * * * *